US010378288B2

(12) United States Patent
Hall et al.

(10) Patent No.: US 10,378,288 B2
(45) Date of Patent: Aug. 13, 2019

(54) DOWNHOLE DRILL BIT INCORPORATING CUTTING ELEMENTS OF DIFFERENT GEOMETRIES

(71) Applicant: Schlumberger Technology Corporation, Sugar Land, TX (US)

(72) Inventors: David R. Hall, Provo, UT (US); John D. Bailey, Provo, UT (US); Ronald B. Crockett, Provo, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/651,308

(22) Filed: Jul. 17, 2017

(65) Prior Publication Data

US 2017/0314333 A1 Nov. 2, 2017
US 2018/0258706 A9 Sep. 13, 2018

Related U.S. Application Data

(63) Continuation of application No. 14/717,567, filed on May 20, 2015, now Pat. No. 9,708,856, which is a continuation of application No. 14/089,385, filed on Nov. 25, 2013, now Pat. No. 9,051,795, which is a continuation of application No. 11/861,641, filed on (Continued)

(51) Int. Cl.

| | |
|---|---|
| ***E21B 10/43*** | (2006.01) |
| ***E21B 10/55*** | (2006.01) |
| ***E21B 10/573*** | (2006.01) |
| ***E21B 10/567*** | (2006.01) |
| *E21B 10/42* | (2006.01) |
| *E21B 10/54* | (2006.01) |

(52) U.S. Cl.

CPC ..... *E21B 10/55* (2013.01); *E21B 10/43* (2013.01); *E21B 10/5673* (2013.01); *E21B 10/5735* (2013.01); *E21B 2010/425* (2013.01); *E21B 2010/545* (2013.01)

(58) Field of Classification Search

CPC ..... E21B 10/43; E21B 10/5735; E21B 10/55; E21B 2010/545

See application file for complete search history.

(56) References Cited

U.S. PATENT DOCUMENTS 4,315 A 12/1845 Hemming
37,223 A 12/1862 Fosdick (Continued)

FOREIGN PATENT DOCUMENTS

DE 2442146 A1 3/1976
DE 3307910 A1 9/1984

(Continued)

OTHER PUBLICATIONS

SME Mining Engineering Handbook, 1992, pp. 691-692.

(Continued)

*Primary Examiner* — Janine M Kreck

(57) ABSTRACT

A downhole cutting tool may include a tool body, a plurality of blades extending from the tool body, and a plurality of cutting elements coupled to the blades. The plurality of cutting elements may include one or more cutting elements having a working end of a first geometry (e.g., a pointed geometry) and one or more cutting elements having a working end of a second geometry (e.g., a planar geometry).

22 Claims, 10 Drawing Sheets

Related U.S. Application Data

Sep. 26, 2007, now Pat. No. 8,590,644, which is a continuation-in-part of application No. 11/829,577, filed on Jul. 27, 2007, now Pat. No. 8,622,155, which is a continuation-in-part of application No. 11/766,975, filed on Jun. 22, 2007, now Pat. No. 8,122,980, said application No. 11/861,641 is a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, now abandoned, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, said application No. 11/861,641 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS 465,103 A 12/1891 Wegner
616,118 A 12/1898 Kuhne
946,060 A 1/1910 Looker
1,116,154 A 11/1914 Stowers
1,183,630 A 5/1916 Bryson
1,189,560 A 7/1916 Gondos
1,360,908 A 11/1920 August
1,387,733 A 8/1921 Midgett
1,460,671 A 7/1923 Hebsacker
1,544,757 A 7/1925 Hufford
1,821,474 A 9/1931 Mercer
1,879,177 A 9/1932 Gault
2,004,315 A 6/1935 Fean
2,054,255 A 9/1936 Howard
2,064,255 A 12/1936 Garfield
2,121,202 A 6/1938 Killgore
2,124,438 A 7/1938 Struk et al.
2,169,223 A 8/1939 Christian
2,218,130 A 10/1940 Court
2,320,136 A 5/1943 Kramerer
2,466,991 A 4/1949 Kramerer
2,540,464 A 2/1951 Stokes
2,544,036 A 3/1951 McCann
2,545,036 A 3/1951 Kramerer
2,755,071 A 7/1956 Kramerer
2,776,819 A 1/1957 Brown
2,819,043 A 1/1958 Henderson
2,838,284 A 6/1958 Austin
2,894,722 A 7/1959 Buttolph
2,963,102 A 12/1960 Smith
3,135,341 A 6/1964 Ritter
3,254,392 A 6/1966 Novkov
3,294,186 A 12/1966 Buell
3,301,339 A 1/1967 Pennebaker, Jr.
3,342,531 A 9/1967 Krekeler
3,342,532 A 9/1967 Krekeler
3,379,264 A 4/1968 Cox
3,397,012 A 8/1968 Krekeler
3,429,390 A 2/1969 Bennett
2,901,223 A 8/1969 Scott
3,493,165 A 2/1970 Schonfeld
3,512,838 A 5/1970 Kniff
3,583,504 A 6/1971 Aalund
3,626,775 A 12/1971 Gentry
3,650,565 A 3/1972 Kniff
3,655,244 A 4/1972 Swisher
3,745,396 A 7/1973 Quintal et al.
3,745,623 A 7/1973 Wentorf, Jr. et al.
3,746,396 A 7/1973 Radd
3,764,493 A 10/1973 Nicks
3,765,493 A 10/1973 Rosar et al.
3,800,891 A 4/1974 White et al.
3,807,804 A 4/1974 Kniff
3,820,848 A 6/1974 Kniff
3,821,993 A 7/1974 Kniff
3,830,321 A 8/1974 McKenry et al.
3,932,952 A 1/1976 Helton et al.
3,942,838 A 3/1976 Bailey et al.
3,945,681 A 3/1976 White
3,955,635 A 5/1976 Skidmore
3,957,307 A 5/1976 Varda
3,960,223 A 6/1976 Kleine
4,005,914 A 2/1977 Newman
4,006,936 A 2/1977 Crabiel
4,081,042 A 3/1978 Johnson et al.
4,096,917 A 6/1978 Harris
4,098,362 A 7/1978 Bonnice
4,106,577 A 8/1978 Summers
4,109,737 A 8/1978 Bovenkerk
RE29,900 E 2/1979 Kniff
4,140,004 A 2/1979 Smith et al.
4,156,329 A 5/1979 Daniels et al.
4,176,723 A 12/1979 Arceneaux
4,199,035 A 4/1980 Thompson
4,201,421 A 5/1980 Den Besten et al.
4,211,508 A 7/1980 Dill et al.
4,224,380 A 9/1980 Bovenkerk et al.
4,247,150 A 1/1981 Wrulich et al.
4,251,109 A 2/1981 Roepke
4,253,533 A 3/1981 Baker, III
4,268,089 A 5/1981 Spence et al.
4,277,106 A 7/1981 Sahley
4,280,573 A 7/1981 Sudnishnikov et al.
4,289,211 A 9/1981 Lumen
4,304,312 A 12/1981 Larsson
4,307,786 A 12/1981 Evans
D264,217 S 5/1982 Prause et al.
4,333,902 A 6/1982 Hara
4,333,986 A 6/1982 Tsuji et al.
4,337,980 A 7/1982 Krekeler
4,390,992 A 6/1983 Judd
4,397,361 A 8/1983 Langford, Jr.
4,397,362 A 8/1983 Dice et al.
4,412,980 A 11/1983 Tsuji et al.
4,416,339 A 11/1983 Baker et al.
4,425,315 A 1/1984 Tsuji et al.
4,439,250 A 3/1984 Acharya et al.
4,445,580 A 5/1984 Sahley
4,448,269 A 5/1984 Ishikawa et al.
4,465,221 A 8/1984 Schmidt
4,481,016 A 11/1984 Campbell et al.
4,484,644 A 11/1984 Cook et al.
4,484,783 A 11/1984 Emmerich
4,489,986 A 12/1984 Dziak
4,497,520 A 2/1985 Ojanen
4,499,795 A 2/1985 Radtke
4,525,178 A 6/1985 Hall
4,531,592 A 7/1985 Hayatdavoudi
4,535,853 A 8/1985 Ippolito et al.
4,537,448 A 8/1985 Ketterer

(56) References Cited

U.S. PATENT DOCUMENTS 4,538,691 A 9/1985 Dennis
4,542,942 A 9/1985 Zitz et al.
4,566,545 A 1/1986 Story et al.
4,573,744 A 3/1986 Clemmow et al.
4,574,895 A 3/1986 Dolezal et al.
4,583,786 A 4/1986 Thorpe et al.
4,599,731 A 7/1986 Ware et al.
4,604,106 A 8/1986 Hall
4,627,503 A 12/1986 Horton
4,627,665 A 12/1986 Ewing et al.
4,636,253 A 1/1987 Nakai et al.
4,636,353 A 1/1987 Seon et al.
4,640,374 A 2/1987 Dennis
4,647,111 A 3/1987 Bronder et al.
4,647,546 A 3/1987 Hall, Jr. et al.
4,650,776 A 3/1987 Cerceau et al.
4,655,508 A 4/1987 Tomlinson
4,657,308 A 4/1987 Clapham
4,660,890 A 4/1987 Mills
4,662,348 A 5/1987 Hall et al.
4,664,705 A 5/1987 Horton et al.
4,678,237 A 7/1987 Collin
4,682,987 A 7/1987 Brady et al.
4,684,176 A 8/1987 Den Besten et al.
4,688,856 A 8/1987 Elfgen
4,690,691 A 9/1987 Komanduri
4,694,918 A 9/1987 Hall
4,702,525 A 10/1987 Sollami et al.
4,725,098 A 2/1988 Beach
4,726,718 A 2/1988 Meskin et al.
4,728,153 A 3/1988 Ojanen et al.
4,729,440 A 3/1988 Hall
4,729,441 A 3/1988 Peetz et al.
4,729,603 A 3/1988 Elfgen
4,736,533 A 4/1988 May et al.
4,746,379 A 5/1988 Rabinkin
4,765,419 A 8/1988 Scholz et al.
4,765,686 A 8/1988 Adams
4,765,687 A 8/1988 Parrott
4,776,862 A 10/1988 Wiand
4,798,026 A 1/1989 Cerceau
4,804,231 A 2/1989 Buljan et al.
4,811,801 A 3/1989 Salesky et al.
4,815,342 A 3/1989 Brett et al.
4,836,614 A 6/1989 Ojanen
4,850,649 A 7/1989 Beach et al.
4,852,672 A 8/1989 Behrens
4,880,154 A 11/1989 Tank
4,889,017 A 12/1989 Fuller et al.
4,893,875 A 1/1990 Lonn et al.
D305,871 S 2/1990 Geiger
4,921,310 A 5/1990 Hedlund et al.
D308,683 S 6/1990 Meyers
4,932,723 A 6/1990 Mills
4,940,099 A 7/1990 Deane et al.
4,940,288 A 7/1990 Stiffler et al.
4,944,559 A 7/1990 Sionnet et al.
4,944,772 A 7/1990 Cho
4,951,762 A 8/1990 Lundell
4,956,238 A 9/1990 Griffin
4,962,822 A 10/1990 Pascale
4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,038,873 A 8/1991 Jurgens
D324,056 S 2/1992 Frazee
D324,226 S 2/1992 Frazee
5,088,797 A 2/1992 ONeill
5,092,310 A 3/1992 Walen et al.
5,106,166 A 4/1992 ONeill
5,112,165 A 5/1992 Hedlund et al.
5,119,714 A 6/1992 Scott et al.
5,119,892 A 6/1992 Clegg et al.
5,120,327 A 6/1992 Dennis
5,141,063 A 8/1992 Quesenbury
5,141,289 A 8/1992 Stiffler
D329,809 S 9/1992 Bloomfield
5,154,245 A 10/1992 Waldenstrom et al.
5,186,268 A 2/1993 Clegg
5,186,892 A 2/1993 Pope
5,222,566 A 6/1993 Taylor et al.
5,235,961 A 8/1993 McShannon
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,319,855 A 6/1994 Beevers et al.
5,332,051 A 7/1994 Knowlton
5,332,348 A 7/1994 Lemelson
5,351,770 A 10/1994 Cawthorne et al.
5,361,859 A 11/1994 Tibbitts
5,364,319 A 11/1994 Boll et al.
5,374,319 A 12/1994 Stueber et al.
D357,485 S 4/1995 Mattsson et al.
5,410,303 A 4/1995 Comeau et al.
5,415,462 A 5/1995 Massa
5,417,292 A 5/1995 Polakoff
5,417,475 A 5/1995 Graham et al.
5,423,389 A 6/1995 Warren et al.
5,447,208 A 9/1995 Lund et al.
5,494,477 A 2/1996 Flood et al.
5,503,463 A 4/1996 Ojanen
5,507,357 A 4/1996 Hult et al.
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund et al.
5,655,614 A 8/1997 Azar
5,662,720 A 9/1997 OTighearnaigh
5,678,644 A 10/1997 Fielder
5,709,279 A 1/1998 Dennis
5,720,528 A 2/1998 Ritchey
5,725,283 A 3/1998 ONeill
5,730,502 A 3/1998 Montgomery, Jr.
5,732,784 A 3/1998 Nelson
5,738,415 A 4/1998 Parrott
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood et al.
5,871,060 A * 2/1999 Jensen ..... E21B 10/5673 175/420.2
5,873,423 A 2/1999 Briese
5,875,862 A 3/1999 Jurewicz et al.
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,967,250 A 10/1999 Lund et al.
5,979,571 A 11/1999 Scott et al.
5,992,405 A 11/1999 Sollami
5,992,547 A 11/1999 Caraway et al.
5,992,548 A 11/1999 Silva et al.

(56) References Cited

U.S. PATENT DOCUMENTS 6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts et al.
6,039,131 A 3/2000 Beaton
6,041,875 A 3/2000 Rai et al.
6,044,920 A 4/2000 Massa et al.
6,051,079 A 4/2000 Andersson et al.
6,056,911 A 5/2000 Griffin
6,059,054 A 5/2000 Portwood et al.
6,065,552 A 5/2000 Scott et al.
6,068,072 A 5/2000 Besson et al.
6,068,913 A 5/2000 Cho et al.
6,095,262 A 8/2000 Chen
6,098,730 A 8/2000 Scott et al.
6,102,486 A 8/2000 Briese
6,109,377 A 8/2000 Massa et al.
6,113,195 A 9/2000 Mercier et al.
6,131,675 A 10/2000 Anderson
6,150,822 A 11/2000 Hong et al.
6,170,917 B1 1/2001 Heinrich et al.
6,176,333 B1 * 1/2001 Doster ..... E21B 10/52 175/428
6,186,251 B1 2/2001 Butcher
6,193,770 B1 2/2001 Sung
6,196,340 B1 3/2001 Jensen et al.
6,196,636 B1 3/2001 Mills et al.
6,196,910 B1 3/2001 Johnson et al.
6,199,645 B1 3/2001 Anderson et al.
6,199,956 B1 3/2001 Kammerer
6,202,761 B1 3/2001 Forney
6,213,226 B1 4/2001 Eppink et al.
6,216,805 B1 4/2001 Lays et al.
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton et al.
6,270,165 B1 8/2001 Peay
6,272,748 B1 8/2001 Smyth
6,290,007 B2 9/2001 Beuershausen et al.
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 11/2001 Yong et al.
6,332,503 B1 12/2001 Pessier et al.
6,340,064 B2 1/2002 Fielder et al.
6,341,823 B1 1/2002 Sollami
6,354,771 B1 3/2002 Bauschulte et al.
6,357,832 B1 3/2002 Sollami
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson et al.
6,408,052 B1 6/2002 McGeoch
6,408,959 B2 6/2002 Bertagnolli et al.
6,412,560 B1 7/2002 Bernat
6,419,278 B1 7/2002 Cunningham
6,424,919 B1 7/2002 Moran et al.
6,429,398 B1 8/2002 Legoupil et al.
6,435,287 B2 8/2002 Estes
6,439,326 B1 8/2002 Huang et al.
6,460,637 B1 10/2002 Siracki et al.
6,468,368 B1 10/2002 Merrick et al.
6,474,425 B1 11/2002 Truax et al.
6,478,383 B1 11/2002 Ojanen et al.
6,481,803 B2 11/2002 Ritchey
6,484,825 B2 11/2002 Watson et al.
6,484,826 B1 11/2002 Anderson et al.
6,499,547 B2 12/2002 Scott et al.
6,508,318 B1 1/2003 Linden et al.
6,508,516 B1 1/2003 Kammerer
6,510,906 B1 1/2003 Richert et al.
6,513,606 B1 2/2003 Krueger
6,516,293 B1 2/2003 Huang et al.
6,517,902 B2 2/2003 Drake et al.
6,533,050 B2 3/2003 Molloy
6,561,293 B2 5/2003 Minikus et al.
6,562,462 B2 5/2003 Griffin et al.
RE38,151 E 6/2003 Penkunas et al.
D477,225 S 7/2003 Pinnavaia
6,585,326 B2 7/2003 Sollami
6,585,327 B2 7/2003 Sollami
6,592,985 B2 7/2003 Griffin et al.
6,594,881 B2 7/2003 Tibbitts
6,596,225 B1 7/2003 Pope et al.
6,601,454 B1 8/2003 Botnan
6,601,662 B2 8/2003 Matthias et al.
6,622,803 B2 9/2003 Harvey et al.
6,644,755 B1 11/2003 Kammerer
6,659,206 B2 12/2003 Liang et al.
6,668,949 B1 12/2003 Rives
6,670,880 B1 12/2003 Hall et al.
6,672,406 B2 1/2004 Beuershausen
6,685,273 B1 2/2004 Sollami
6,692,083 B2 2/2004 Latham
6,702,393 B2 3/2004 Mercier
6,709,065 B2 3/2004 Peay et al.
6,711,060 B2 3/2004 Sakakibara
6,719,074 B2 4/2004 Tsuda et al.
6,729,420 B2 5/2004 Mensa-Wilmot
6,732,817 B2 5/2004 Dewey et al.
6,732,914 B2 5/2004 Cadden et al.
6,733,087 B2 5/2004 Hall et al.
6,739,327 B2 5/2004 Sollami
6,749,033 B2 6/2004 Griffin et al.
6,758,530 B2 7/2004 Sollami
D494,031 S 8/2004 Moore, Jr.
D494,064 S 8/2004 Hook
6,786,557 B2 9/2004 Montgomery, Jr.
6,802,676 B2 10/2004 Noggle
6,822,579 B2 11/2004 Goswami et al.
6,824,225 B2 11/2004 Stiffler
6,846,045 B2 1/2005 Sollami
6,851,758 B2 2/2005 Beach
6,854,810 B2 2/2005 Montgomery, Jr.
6,861,137 B2 3/2005 Griffin et al.
6,863,352 B2 3/2005 Sollami
6,878,447 B2 4/2005 Griffin et al.
6,879,947 B1 4/2005 Glass
6,880,744 B2 4/2005 Noro et al.
6,889,890 B2 5/2005 Yamazaki et al.
6,918,636 B2 7/2005 Dawood
6,929,076 B2 8/2005 Fanuel et al.
6,933,049 B2 8/2005 Wan et al.
6,938,961 B2 9/2005 Broom
6,953,096 B2 10/2005 Gledhill et al.
6,959,765 B2 11/2005 Bell
6,962,395 B2 11/2005 Mouthaan
6,966,611 B1 11/2005 Sollami
6,994,404 B1 2/2006 Sollami
7,048,081 B2 5/2006 Smith et al.
7,094,473 B2 8/2006 Takayama et al.
7,097,258 B2 8/2006 Sollami
7,104,344 B2 9/2006 Kriesels et al.
7,152,703 B2 12/2006 Meiners et al.
7,204,560 B2 4/2007 Mercier et al.
7,207,398 B2 4/2007 Runia et al.
7,234,782 B2 6/2007 Stehney
D547,652 S 7/2007 Kerman et al.
D560,699 S 1/2008 Omi
7,320,505 B1 1/2008 Hall et al.
7,338,135 B1 3/2008 Hall et al.
7,350,601 B2 4/2008 Belnap et al.
7,377,341 B2 5/2008 Middlemiss et al.
7,380,888 B2 6/2008 Ojanen

(56) References Cited

U.S. PATENT DOCUMENTS

| | | | | |
|---|---|---|---|---|
| 7,384,105 | B2 | 6/2008 | Hall et al. | |
| 7,387,345 | B2 | 6/2008 | Hall et al. | |
| 7,396,086 | B1 | 7/2008 | Hall et al. | |
| 7,413,256 | B2 | 8/2008 | Hall et al. | |
| 7,445,294 | B2 | 11/2008 | Hall et al. | |
| 7,469,971 | B2 | 12/2008 | Hall et al. | |
| 7,469,972 | B2 | 12/2008 | Hall et al. | |
| 7,475,948 | B2 | 1/2009 | Hall et al. | |
| 7,543,662 | B2 | 6/2009 | Belnap et al. | |
| 7,575,425 | B2 | 8/2009 | Hall et al. | |
| 7,592,077 | B2 | 9/2009 | Gates, Jr. et al. | |
| 7,647,992 | B2 | 1/2010 | Fang et al. | |
| 7,665,552 | B2 | 2/2010 | Hall et al. | |
| 7,669,938 | B2 | 3/2010 | Hall et al. | |
| 7,693,695 | B2 | 4/2010 | Huang et al. | |
| 7,703,559 | B2 | 4/2010 | Shen et al. | |
| 7,730,977 | B2 | 6/2010 | Achilles | |
| 7,757,785 | B2 | 7/2010 | Zhang et al. | |
| 7,798,258 | B2 | 9/2010 | Singh et al. | |
| 7,997,661 | B2 | 8/2011 | Hall et al. | |
| 8,122,980 | B2 | 2/2012 | Hall et al. | |
| 8,567,532 | B2 | 10/2013 | Hall et al. | |
| 8,590,644 | B2 * | 11/2013 | Hall | E21B 10/43 175/426 |
| 8,622,155 | B2 | 1/2014 | Hall et al. | |
| 8,794,356 | B2 | 8/2014 | Lyons et al. | |
| 9,051,795 | B2 * | 6/2015 | Hall | E21B 10/5735 |
| 9,145,742 | B2 | 9/2015 | Hall et al. | |
| 9,708,856 | B2 | 7/2017 | Hall et al. | |
| 2001/0004946 | A1 | 6/2001 | Jensen | |
| 2001/0040053 | A1 | 11/2001 | Beuershausen | |
| 2002/0070602 | A1 | 6/2002 | Sollami | |
| 2002/0074851 | A1 | 6/2002 | Montgomery | |
| 2002/0153175 | A1 | 10/2002 | Ojanen | |
| 2002/0175555 | A1 | 11/2002 | Mercier | |
| 2003/0044800 | A1 | 3/2003 | Connelly et al. | |
| 2003/0079565 | A1 | 5/2003 | Liang et al. | |
| 2003/0137185 | A1 | 7/2003 | Sollami | |
| 2003/0140360 | A1 | 7/2003 | Mansuy et al. | |
| 2003/0141350 | A1 | 7/2003 | Noro et al. | |
| 2003/0141753 | A1 | 7/2003 | Peay et al. | |
| 2003/0209366 | A1 | 11/2003 | McAlvain | |
| 2003/0213621 | A1 | 11/2003 | Britten et al. | |
| 2003/0217869 | A1 | 11/2003 | Snyder et al. | |
| 2003/0230926 | A1 | 12/2003 | Mondy et al. | |
| 2003/0234280 | A1 | 12/2003 | Cadden et al. | |
| 2004/0026132 | A1 | 2/2004 | Hall et al. | |
| 2004/0026983 | A1 | 2/2004 | McAlvain | |
| 2004/0065484 | A1 | 4/2004 | McAlvain | |
| 2004/0155096 | A1 | 8/2004 | Zimmerman et al. | |
| 2004/0228694 | A1 | 11/2004 | Webb et al. | |
| 2004/0238221 | A1 | 12/2004 | Runia et al. | |
| 2004/0256155 | A1 | 12/2004 | Kriesels et al. | |
| 2004/0256442 | A1 | 12/2004 | Gates, Jr. et al. | |
| 2005/0035649 | A1 | 2/2005 | Mercier et al. | |
| 2005/0044800 | A1 | 3/2005 | Hall et al. | |
| 2005/0044987 | A1 | 3/2005 | Takayama et al. | |
| 2005/0080595 | A1 | 4/2005 | Huang | |
| 2005/0103530 | A1 | 5/2005 | Wheeler et al. | |
| 2005/0159840 | A1 | 7/2005 | Lin et al. | |
| 2005/0173966 | A1 | 8/2005 | Mouthaan | |
| 2005/0263327 | A1 | 12/2005 | Meiners et al. | |
| 2006/0032677 | A1 | 2/2006 | Azar et al. | |
| 2006/0060391 | A1 | 3/2006 | Eyre et al. | |
| 2006/0086537 | A1 | 4/2006 | Dennis | |
| 2006/0086540 | A1 | 4/2006 | Griffin et al. | |
| 2006/0125306 | A1 | 6/2006 | Sollami | |
| 2006/0131075 | A1 * | 6/2006 | Cruz | E21B 10/36 175/57 |
| 2006/0162969 | A1 | 7/2006 | Belnap et al. | |
| 2006/0180354 | A1 | 8/2006 | Belnap et al. | |
| 2006/0180356 | A1 | 8/2006 | Durairajan et al. | |
| 2006/0186724 | A1 | 8/2006 | Stehney | |
| 2006/0237236 | A1 | 10/2006 | Sreshta et al. | |
| 2007/0013224 | A1 | 1/2007 | Stehney | |
| 2007/0106487 | A1 | 5/2007 | Gavia et al. | |
| 2007/0193782 | A1 | 8/2007 | Fang et al. | |
| 2007/0221408 | A1 | 9/2007 | Hall et al. | |
| 2007/0278017 | A1 | 12/2007 | Shen et al. | |
| 2008/0006448 | A1 | 1/2008 | Zhang et al. | |
| 2008/0011522 | A1 | 1/2008 | Hall et al. | |
| 2008/0053710 | A1 | 3/2008 | Moss | |
| 2008/0073126 | A1 | 3/2008 | Shen et al. | |
| 2008/0073127 | A1 | 3/2008 | Zhan et al. | |
| 2008/0142276 | A1 | 6/2008 | Griffo et al. | |
| 2008/0156544 | A1 | 7/2008 | Singh et al. | |
| 2008/0206576 | A1 | 8/2008 | Qian et al. | |
| 2009/0166091 | A1 | 7/2009 | Matthews et al. | |
| 2009/0223721 | A1 | 9/2009 | Dourfaye | |
| 2015/0252624 | A1 | 9/2015 | Hall et al. | |
| 2015/0354285 | A1 | 12/2015 | Hall et al. | |

FOREIGN PATENT DOCUMENTS

| | | | | |
|---|---|---|---|---|
| DE | 3431888 | A1 | 3/1985 | |
| DE | 3500261 | A1 | 7/1986 | |
| DE | 3818213 | | 11/1989 | |
| DE | 4039217 | | 6/1992 | |
| DE | 4210955 | | 10/1993 | |
| DE | 19821147 | A1 | 11/1999 | |
| DE | 10163717 | C1 | 5/2003 | |
| EP | 0295151 | | 12/1988 | |
| EP | 0412287 | | 2/1991 | |
| EP | 1574309 | | 9/2005 | |
| GB | 2004315 | | 3/1979 | |
| GB | 2037223 | | 7/1980 | |
| GB | 2146058 | | 4/1985 | |
| JP | S60145973 | | 8/1985 | |
| JP | 5280273 | | 10/1993 | |
| JP | 3123193 | | 1/2001 | |
| JP | 2002081524 | A | 3/2002 | |
| RU | 2263212 | | 10/2005 | |
| WO | WO9213169 | | 8/1992 | |
| WO | WO-9213169 | A1 * | 8/1992 | E21B 10/56 |

OTHER PUBLICATIONS

International search report for PCT/US2007/075670, dated Nov. 17, 2008.

Chaturvedi et al., Diffusion Brazing of Cast Inconel 738 Superalloy, Sep. 2005, Journal of Materials Online (http//www.azom.com/details.asp?ArticleID=2995), 12 pages.

International Report on Patentability Chapter I for PCT/US2007/075670, dated Feb. 17, 2009, 6 pages.

International Preliminary Report on Patentability Chapter II for PCT/US2007/075670, dated Aug. 24, 2009, 4 pages.

Durrand et al., Super-hard, Thick, Shaped PDC Cutters for Hard Rock Drilling: Development and Test Results, Feb. 3, 2010, Geothermal Reservoir Engineering, Stanford, CA, pp. 1-8.

Glowka et al., Progress in the Advanced Synthetic-Diamond Drill Bit Program, 1995, pp. 1-9.

G. Jeffrey Hoch, Is There Room for Geothermal Energy, Innovation: America's Journal of Technology Communication, Dec. 2006/Jan. 2007, pp. 1-3, web print at http://www.innovation-america.org/archive.php?articleID=215.

Dan Jennejohn, Research and Development in Geothermal Exploration and Drilling, Dec. 2009, Geothermal Energy Association, Washington, D.C, pp. 5, 18, and 19.

Mark A. Taylor, The State of Geothermal Technology, Part 1: Subsurface Technology, Nov. 2007, pp. 29-30, Geothermal Energy Association for the US Department of Energy, Washington, DC.

US Department of Energy, Geothermal Drilling, Faster and Cheaper is Better, Geothermal Today, May 2000, National Technology Information Service, Springfield, VA, p. 28.

Kennametal Inc., Catalog entitled "Construction Tools", 1997, pp. 1-20.

Search Report issued in European Application No. 07873780.6, dated Jun. 3, 2014, 7 pages.

Hartman et al., SME Mining Engineering Handbook, 1993, pp. 891-892.

(56) References Cited

OTHER PUBLICATIONS

Office Action issued in U.S. Appl. No. 14/717,567 dated Oct. 17, 2016, 5 pages.
International Search Report and Written Opinion issued in International Patent Application PCT/US08/069231 dated Nov. 18, 2008, 5 pages.
International Report on Patentability issued in International Patent Application PCT/US08/069231 dated Jan. 5, 2010, 5 pages.
Office Action issued in U.S. Appl. No. 11/829,577 dated Apr. 13, 2009, 8 pages.
Office Action issued in U.S. Appl. No. 11/829,577 dated Oct. 14, 2009, 7 pages.
Office Action issued in U.S. Appl. No. 11/829,577 dated Mar. 15, 2010, 9 pages.
Office Action issued in U.S. Appl. No. 11/829,577 dated Jul. 12, 2011, 9 pages.
Office Action issued in U.S. Appl. No. 11/829,577 dated Dec. 6, 2011, 8 pages.
Office Action issued in U.S. Appl. No. 11/829,577 dated Aug. 22, 2012, 5 pages.
Office Action issued in U.S. Appl. No. 14/101,972 dated Feb. 6, 2015, 6 pages.
Office Action issued in U.S. Appl. No. 14/101,972 dated Oct. 27, 2014, 6 pages.
Office Action issued in U.S. Appl. No. 14/829,037 dated Nov. 16, 2016, 10 pages.
Office Action issued in U.S. Appl. No. 11/773,271 dated Jul. 23, 2009, 8 pages.
Office Action issued in U.S. Appl. No. 11/773,271 dated Mar. 16, 2010, 7 pages.
Office Action issued in U.S. Appl. No. 11/861,641 dated Mar. 22, 2010, 7 pages.
Office Action issued in U.S. Appl. No. 11/861,641 dated Oct. 5, 2009, 5 pages.
Office Action issued in U.S. Appl. No. 14/089,385 dated Oct. 8, 2014, 8 pages.

* cited by examiner

DOWNHOLE DRILL BIT INCORPORATING CUTTING ELEMENTS OF DIFFERENT GEOMETRIES

CROSS REFERENCE TO RELATED APPLICATIONS

This application is a continuation of U.S. patent application Ser. No. 14/717,567, filed on May 20, 2015, now U.S. Pat. No. 9,708,856, which is a continuation of U.S. patent application Ser. No. 14/089,385, filed on Nov. 25, 2013, now U.S. Pat. No. 9,051,795, which is a continuation of U.S. patent application Ser. No. 11/861,641, filed on Sep. 26, 2007, now U.S. Pat. No. 8,590,644, which is a continuation-in-part of U.S. patent application Ser. No. 11/829,577, filed on Jul. 27, 2007, now U.S. Pat. No. 8,622,155, which is a continuation-in-part of U.S. patent application Ser. No. 11/766,975, filed on Jun. 22, 2007, now U.S. Pat. No. 8,122,980, U.S. patent application Ser. No. 11/861,641 is also a continuation-in-part of U.S. patent application Ser. No. 11/774,227, filed on Jul. 7, 2007, now U.S. Pat. No. 7,669,938, which is a continuation-in-part of U.S. patent application Ser. No. 11/773,271, filed on Jul. 3, 2007, now U.S. Pat. No. 7,997,661, which is a continuation-in-part of U.S. patent application Ser. No. 11/766,903, filed on Jun. 22, 2007, now abandoned, which is a continuation of U.S. patent application Ser. No. 11/766,865, filed on Jun. 22, 2007, now abandoned, which is a continuation-in-part of U.S. patent application Ser. No. 11/742,304, filed on Apr. 30, 2007, now U.S. Pat. No. 7,475,948, which is a continuation of U.S. patent application Ser. No. 11/742,261, filed on Apr. 30, 2007, now U.S. Pat. No. 7,469,971, which is a continuation-in-part of U.S. patent application Ser. No. 11/464,008, filed on Aug. 11, 2006, now U.S. Pat. No. 7,338,135, which is a continuation-in-part of U.S. patent application Ser. No. 11/463,998, filed on Aug. 11, 2006, now U.S. Pat. No. 7,384,105, which is a continuation-in-part of U.S. patent application Ser. No. 11/463,990, filed on Aug. 11, 2006, now U.S. Pat. No. 7,320,505, which is a continuation-in-part of U.S. patent application Ser. No. 11/463,975, filed on Aug. 11, 2006, now U.S. Pat. No. 7,445,294, which is a continuation-in-part of U.S. patent application Ser. No. 11/463,962, filed Aug. 11, 2006, now U.S. Pat. No. 7,413,256. U.S. patent application Ser. No. 11/861,641 is also a continuation-in-part of U.S. patent application Ser. No. 11/695,672, filed on Apr. 3, 2007, now U.S. Pat. No. 7,396,086, which is a continuation-in-part of U.S. patent application Ser. No. 11/686,831, filed on Mar. 15, 2007, now U.S. Pat. No. 7,568,770.

BACKGROUND

This invention relates to drill bits, specifically drill bit assemblies for use in oil, gas and geothermal drilling. More particularly, the invention relates to cutting elements in rotary drag bits comprised of a carbide substrate with a non-planar interface and an abrasion resistant layer of superhard material affixed thereto using a high-pressure high-temperature (HPHT) press apparatus. Such cutting elements typically comprise a superhard material layer or layers formed under high temperature and pressure conditions, usually in a press apparatus designed to create such conditions, cemented to a carbide substrate containing a metal binder or catalyst such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the superhard material layer and substrate is particularly susceptible to non-shear failure modes due to inherent residual stresses.

U.S. Pat. No. 6,332,503 to Pessier et al., which is herein incorporated by reference for all that it contains, discloses an array of chisel-shaped cutting elements mounted to the face of a fixed cutter bit, each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,059,054 to Portwood et al., which is herein incorporated by reference fir all that it contains, discloses a cutter element that balances maximum gage-keeping capabilities with minimal tensile stress induced damage to the cutter elements is disclosed. The cutter elements of the present invention have a nonsymmetrical shape and may include a more aggressive cutting profile than conventional cutter elements. In one embodiment, a cutter element is configured such that the inside angle at which its leading face intersects the wear face is less than the inside angle at which its trailing face intersects the wear face. This can also be accomplished by providing the cutter element with a relieved wear face. In another embodiment of the invention, the surfaces of the present cutter element are curvilinear and the transitions between the leading and trailing faces and the gage face are rounded, or contoured. In this embodiment, the leading transition is made sharper than the trailing transition by configuring it such that the leading transition has a smaller radius of curvature than the radius of curvature of the trailing transition. In another embodiment, the cutter element has a chamfered trailing edge such that the leading transition of the cutter element is sharper than its trailing transition. In another embodiment, the cutter element has a chamfered or contoured trailing edge in combination with a canted wear face. In still another embodiment, the cutter element includes a positive rake angle on its leading edge.

SUMMARY

In one aspect, a drill bit has a body intermediate a shank and a working face. The working face has a plurality of blades converging towards a center of the working face and diverging towards a gauge of the working face. A first blade has at least one pointed cutting element with a carbide substrate bonded to a diamond working end with a pointed geometry at a non-planar interface and a second blade has at least one shear cutting element with a carbide substrate bonded to a diamond working end with a flat geometry.

The carbide substrate bonded to the pointed geometry diamond working may have a tapered geometry. A plurality of first blades having the at least one pointed cutting element may alternate with a plurality of second blades having the at least one shear cutting element. A plurality of cutting elements may be arrayed along any portion of their respective blades including a cone portion, nose portion, flank portion, gauge portion, or combinations thereof. When the first and second blades are superimposed on each other, an axis of the at least one pointed cutting element may be offset from an axis of the at least one shear cutting element. An apex of the pointed cutting element may have a 0.050 to 0.200 inch radius. The diamond working end of the pointed cutting element may have a 0.090 to 0.500 inch thickness from the apex to the non-planar interface. A central axis of the pointed cutting element may be tangent to its intended cutting path during a downhole drilling operation. In other embodiments, the central axis of the pointed cutting element may be positioned at an angle relative to its intended cutting path during a downhole drilling operation. The angle of the at least one pointed cutting element on the first blade may be offset from an angle of the at least one shear cutting element on the second blade. A pointed cutting element on the first blade may be oriented at a different angle than an adjacent pointed cutting element on the same blade. The pointed cutting element and the shear cutting element may have different rake angles. The pointed cutting element may generally comprise a smaller rake angle than the shear cutting element. A first pointed cutting element may be located further from the center of the working face than a first shear cutting element. The carbide substrate of the pointed cutting element may be disposed within the first blade. The non-planar interface of the shear cutting element may comprise at least two circumferentially adjacent faces, outwardly angled from a central axis of the substrate.

DETAILED DESCRIPTION

Figure 1:
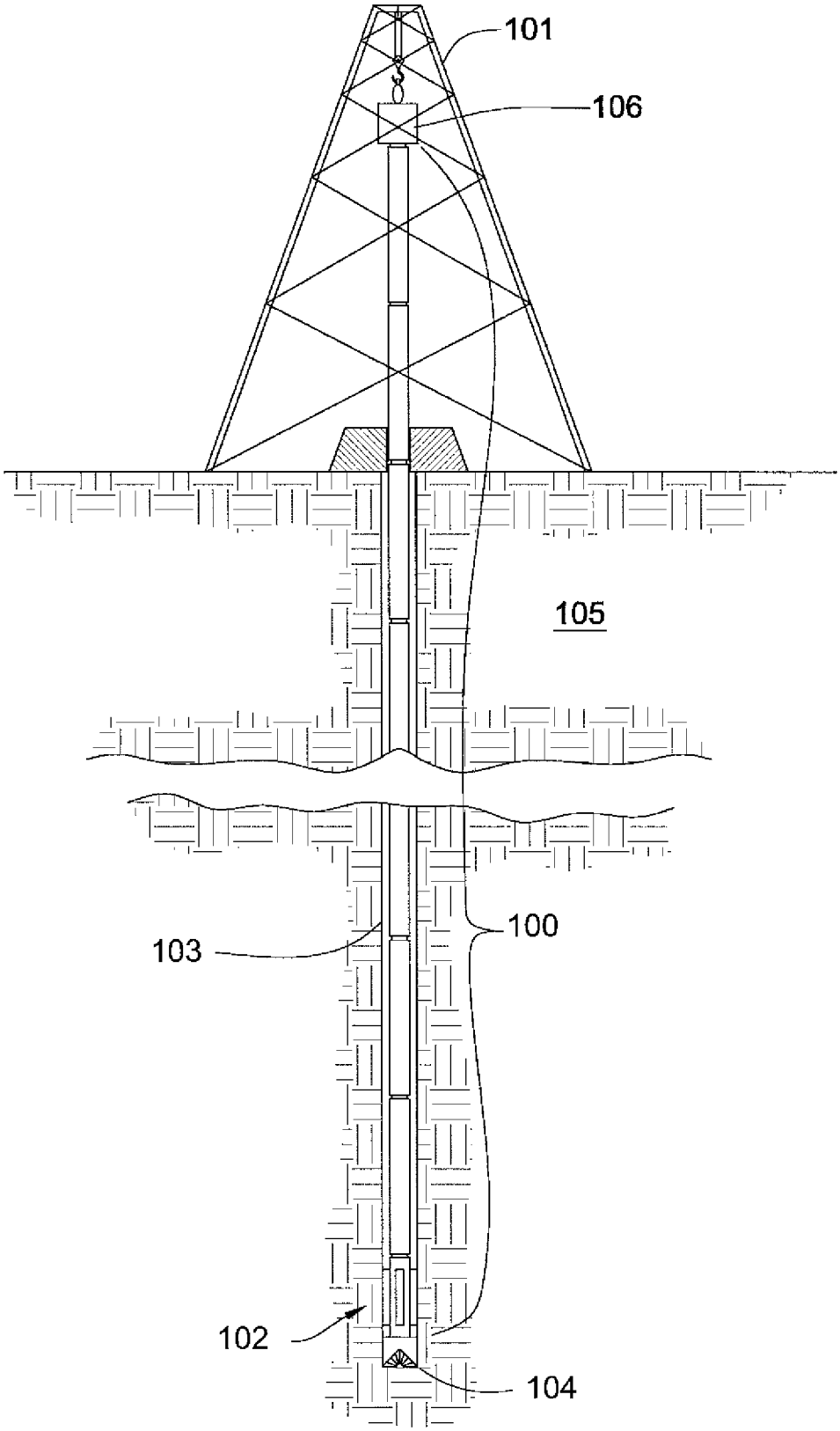
FIG. 1 is a perspective diagram of an embodiment of a drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates downhole the drill string 100 advances farther into the earth. The drill string 100 may penetrate soft or hard subterranean formations 105. The drill bit 104 may break up the formations 105 by cutting and/or chipping the formation 105 during a downhole drilling operation. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
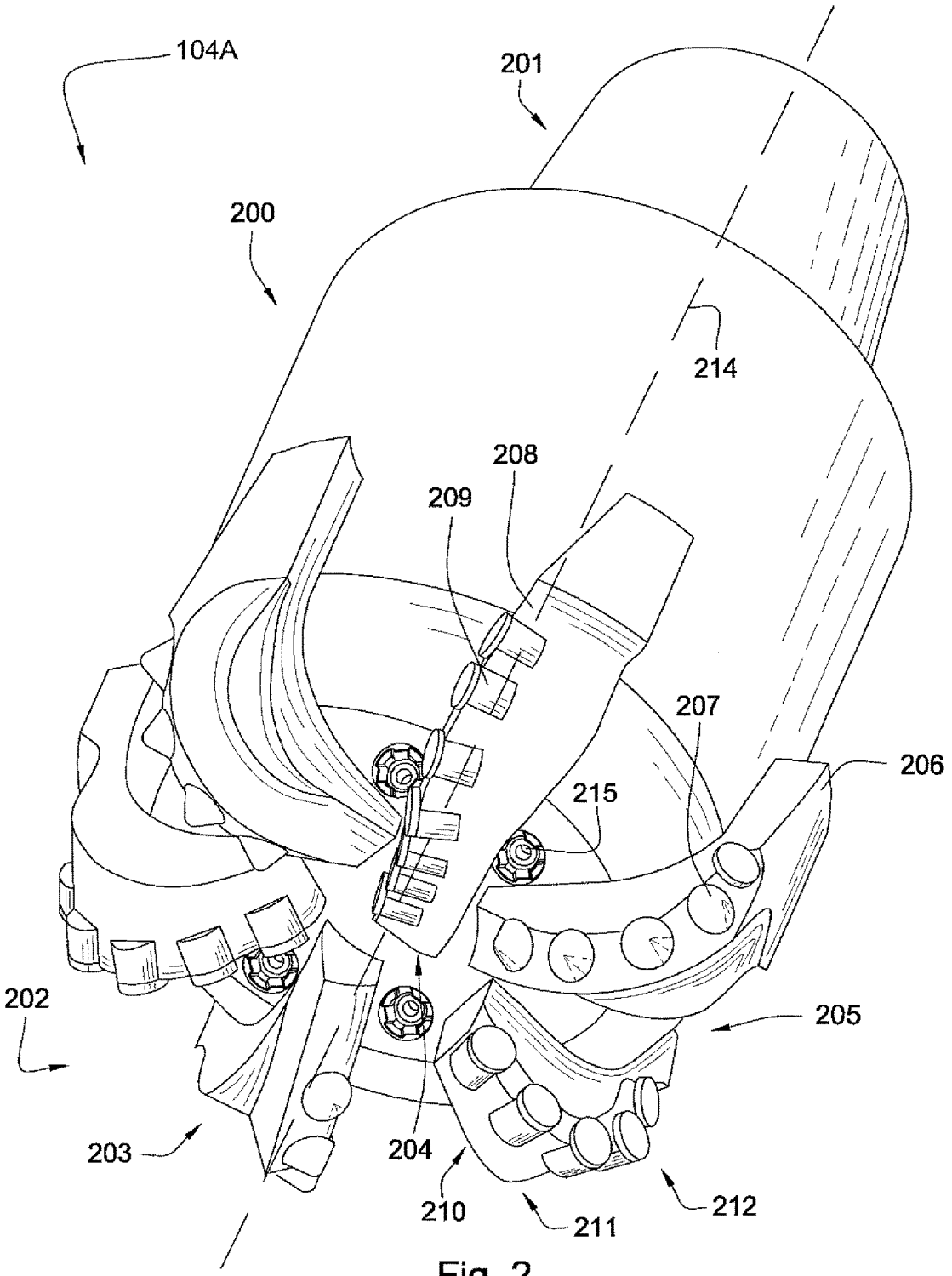
FIG. 2 is a perspective diagram of an embodiment of a drill bit.

In the embodiment of FIG. 2, the drill bit 104A has a body 200 intermediate a shank 201 and a working face 202; the working face 202 having a plurality of blades 203 converging towards a center 204 of the working face 202 and diverging towards a gauge portion 205 of the working face 202. A first blade 206 may have at least one pointed cutting element 207 and a second blade 208 may have at least one shear cutting element 209. In the preferred embodiment, a plurality of first blades 206 having the at least one pointed cutting element 207 may alternate with a plurality of second blades 208 having the at least one shear cutting element 209. A carbide substrate of the pointed cutting element 207 may be disposed within the first blade 206.

Also in this embodiment, a plurality of cutting elements 207, 209, may be arrayed along any portion of their respective blades 206, 208, including a cone portion 210, nose portion 211, flank portion 212, gauge portion 205, or combinations thereof.

Also shown in FIG. 2, a plurality of nozzles 215 may be disposed into recesses formed in the working face 202. Each nozzle 215 may be oriented such that a jet of drilling mud ejected from the nozzles 215 engages the formation before or after the cutting elements 207, 209. The jets of drilling mud may also be used to clean cuttings away from the drill bit 104. The drill bit 104A may be intended for deep oil and gas drilling, although any type of drilling application is anticipated such as horizontal drilling, geothermal drilling, exploration, on and off-shore drilling, directional drilling, water well drilling and any combination thereof.

Figure 3:
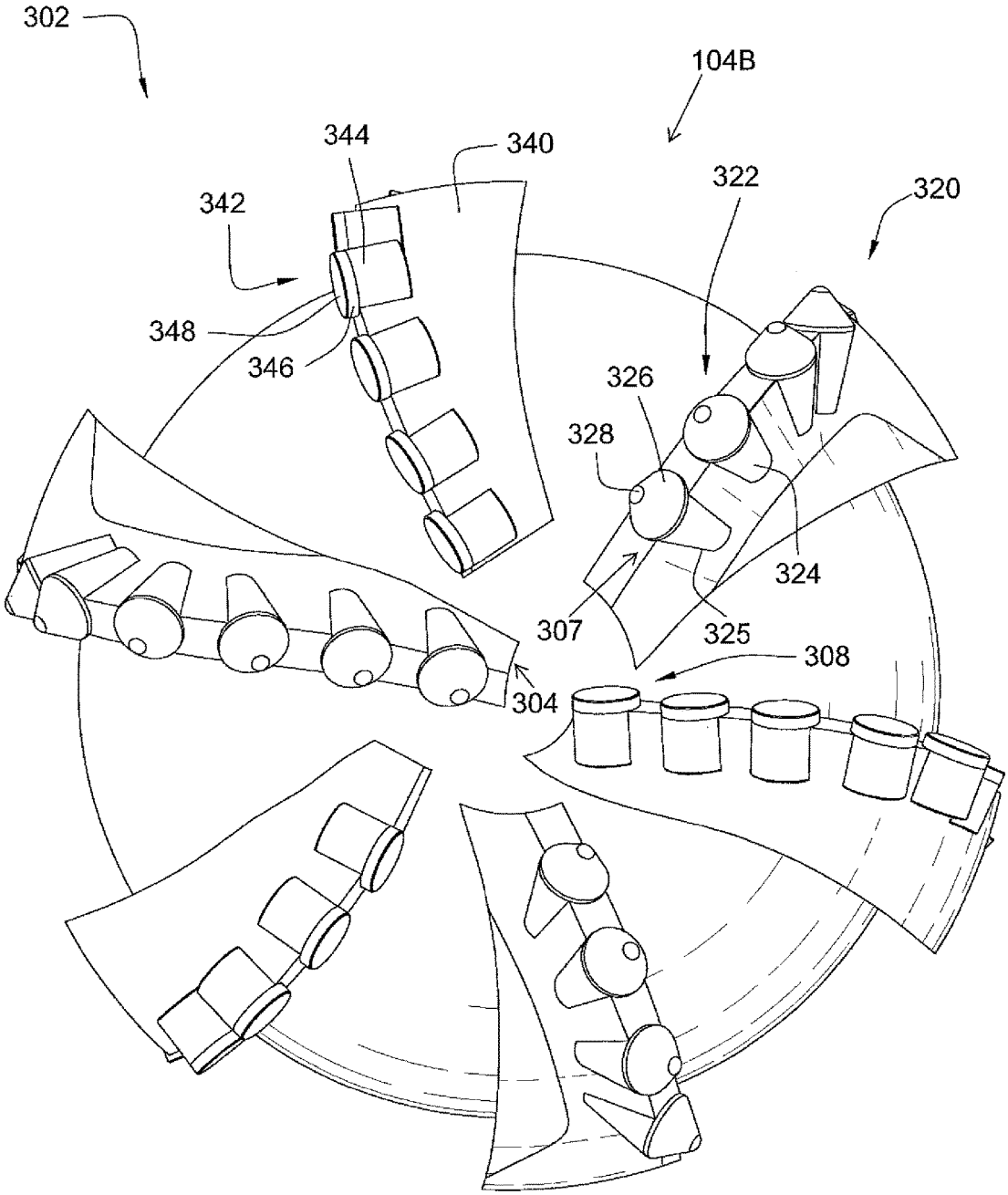
FIG. 3 is an orthogonal diagram of another embodiment of a drill bit.

Referring now to another embodiment of the drill bit 104B illustrated in FIG. 3, the first blade 320 comprises at least one pointed cutting element 322 with a first carbide substrate 324 bonded to a diamond working end 326 with a pointed geometry 328. The second blade 340 comprises at least one shear cutting element 342 with a second carbide substrate 344 bonded to a diamond working end 346 with a flat geometry 348. The first carbide substrate 324 bonded to the pointed geometry diamond working end 326 may have a tapered geometry 325. In this embodiment, a first pointed cutting element 307 may be farther from the center 304 of the working face 302 than a first shear cutting element 308.

Figure 4:
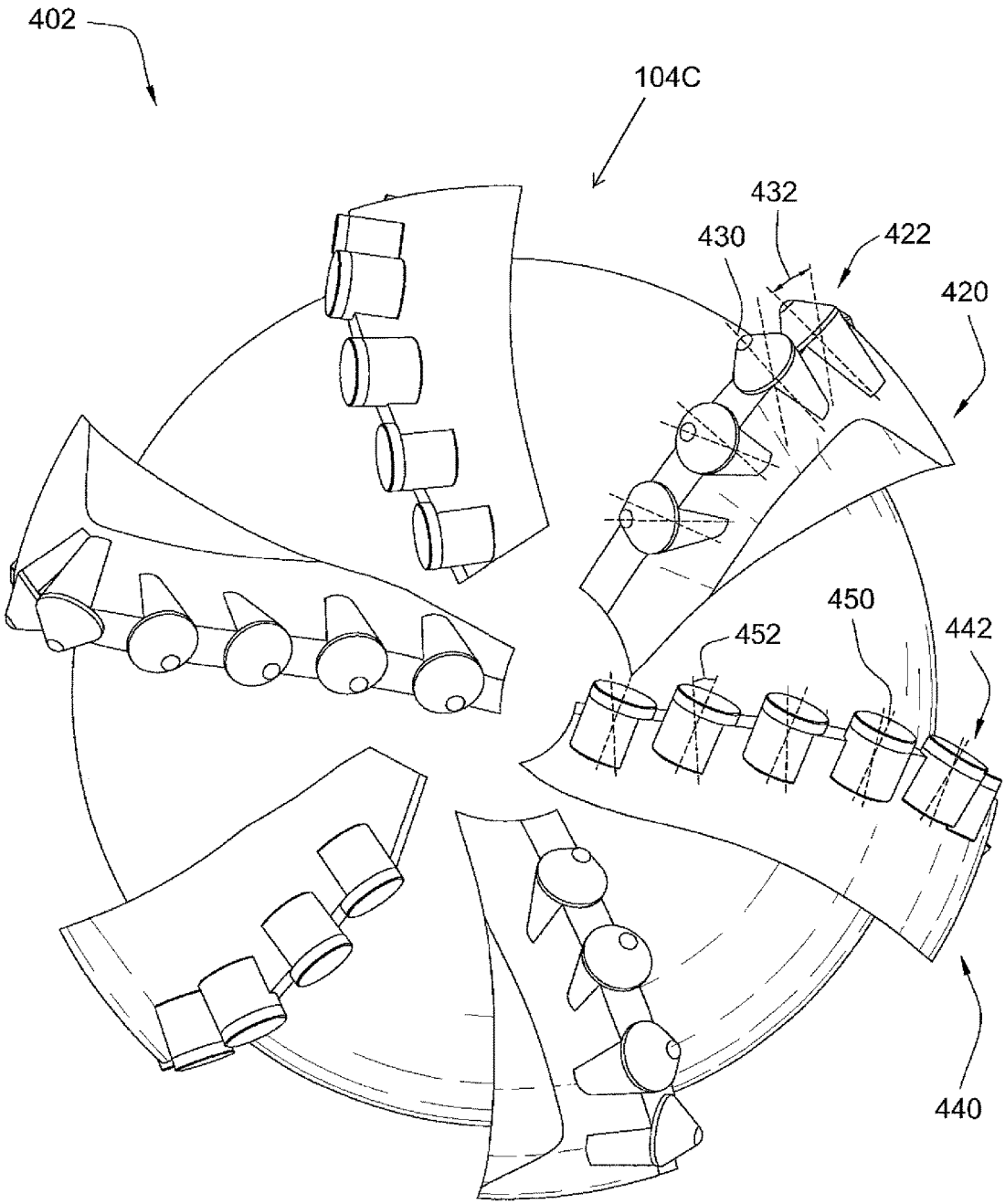
FIG. 4 is an orthogonal diagram of another embodiment of a drill bit.

Referring now to another embodiment of the drill bit 104C illustrated in FIG. 4, a central axis 430 of the pointed cutting element 422 may be positioned at an angle 432 (e.g. side rake, as known to one of skill in the art) relative to a cutting path formed by the working face 402 of the drill bit during a downhole drilling operation. Furthermore, the angle 432 (or side rake) of at least one pointed cutting element 422 on the first blade 420 may be offset from an angle 452 (or side rake) of at least one shear cutting element 442 on the second blade 440 having a central axis 450 positioned at the angle 452 relative to a cutting path. This orientation may be beneficial in that one blade having all its cutting elements at a common angle relative to a cutting path may offset cutting elements on another blade having another common angle. This may result in a more efficient drilling operation.

Figure 5:
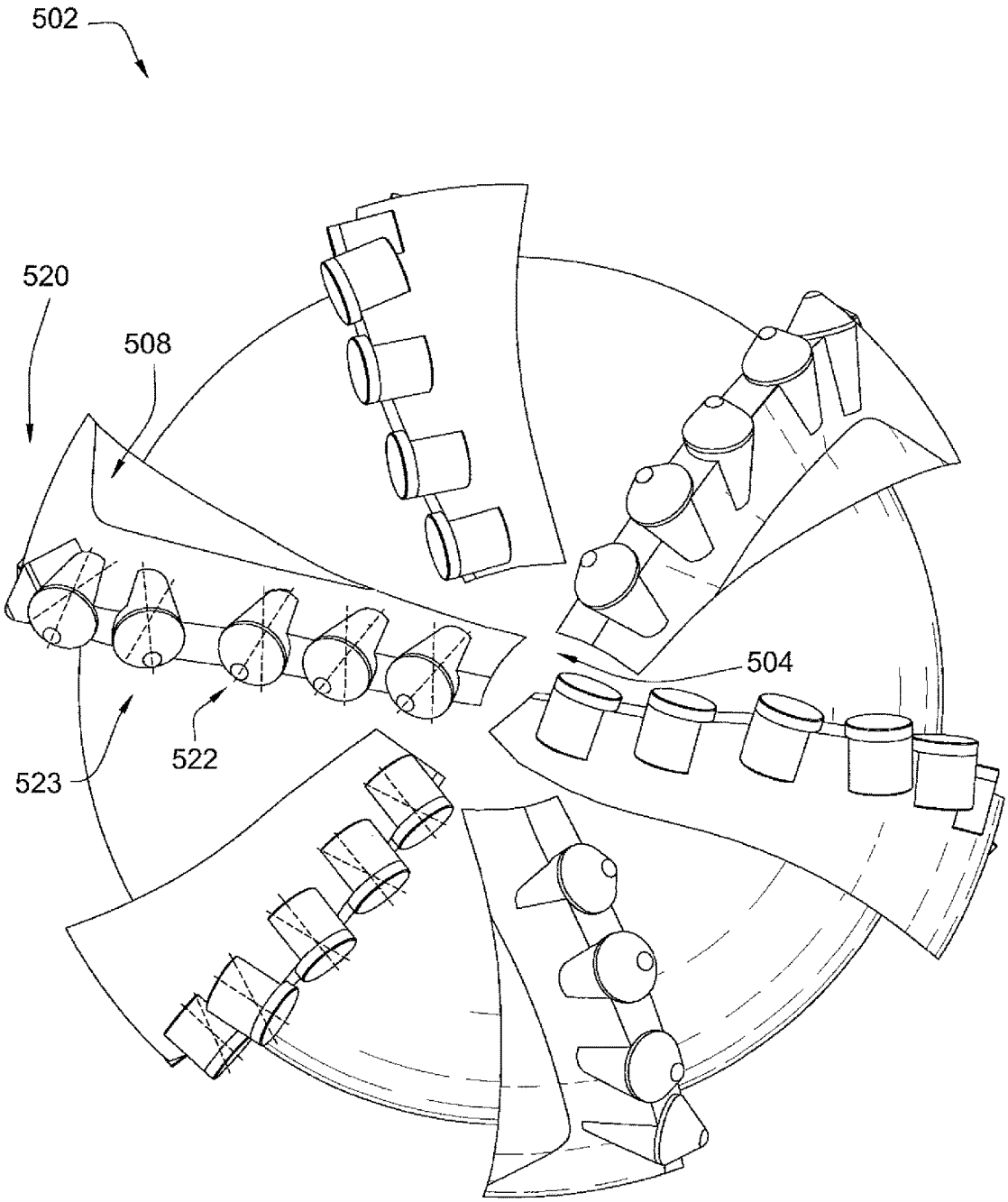
FIG. 5 is an orthogonal diagram of another embodiment of a drill bit.

In the embodiment of the drill bit 104D shown in FIG. 5, the pointed cutting element 522 on the first blade 520 may be oriented at a different angle (side rake) than an adjacent pointed cutting element 523 on the same blade 520. In this embodiment, the pointed cutting elements 522 on the blade 520 nearest the center 504 of the working face 502 may be angled away from a center of the intended circular cutting path, while the pointed cutting elements 523 nearest the gauge portion 508 of the working face 502 may be angled toward the center of the cutting path. This may be beneficial in that cuttings may be forced away from the center 504 of the working face 502 and thereby may be more easily carried to the top of the wellbore.

Figure 6:
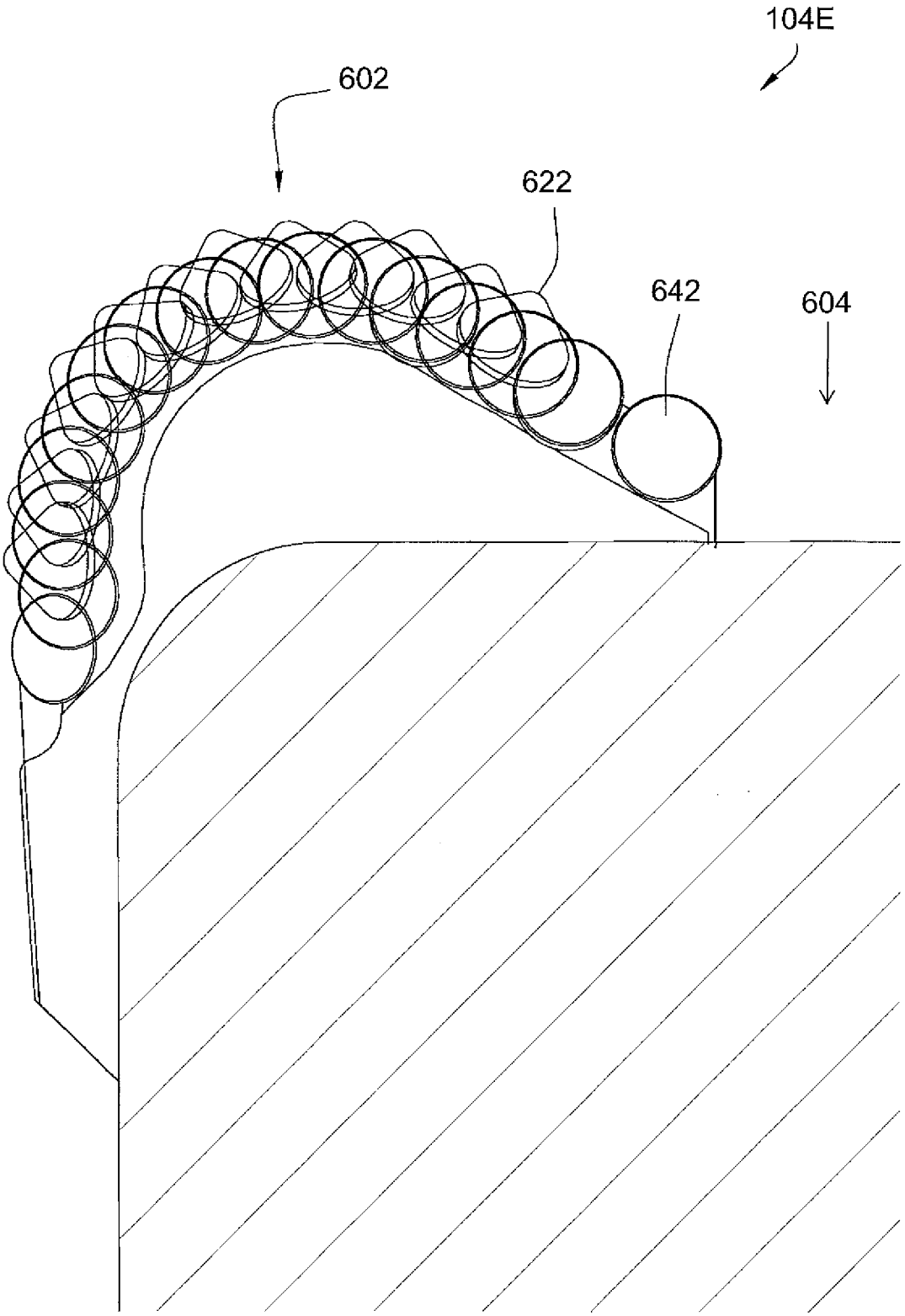
FIG. 6 is a sectional side diagram of an embodiment of a drill bit with a plurality of blades superimposed on one another.

FIG. 6 is a schematic drawing illustrating one embodiment of the drill bit 104E having the plurality of blades graphically superimposed on one another. A plurality of pointed cutting elements 622 on a first blade and a plurality of shear cutting elements 642 on a second blade may comprise different intended cutting paths so that the drilling operation may have an increase in efficiency than if the cutting elements had the same cutting paths. Having cutting elements positioned on the blades at different cutting paths, or radially offset from one another, may break up the formation more quickly and efficiently. As shown in this embodiment, the pointed cutting elements on a first blade may also have a different intended cutting path than the pointed cutting elements on another blade. The shear cutting elements on a second blade may also have a different intended cutting path than the shear cutting elements disposed on another blade. In this embodiment, an innermost shear cutting element 642 may be closer to the center 604 of the working face 602 than an innermost pointed cutting element 622.

Figure 7:
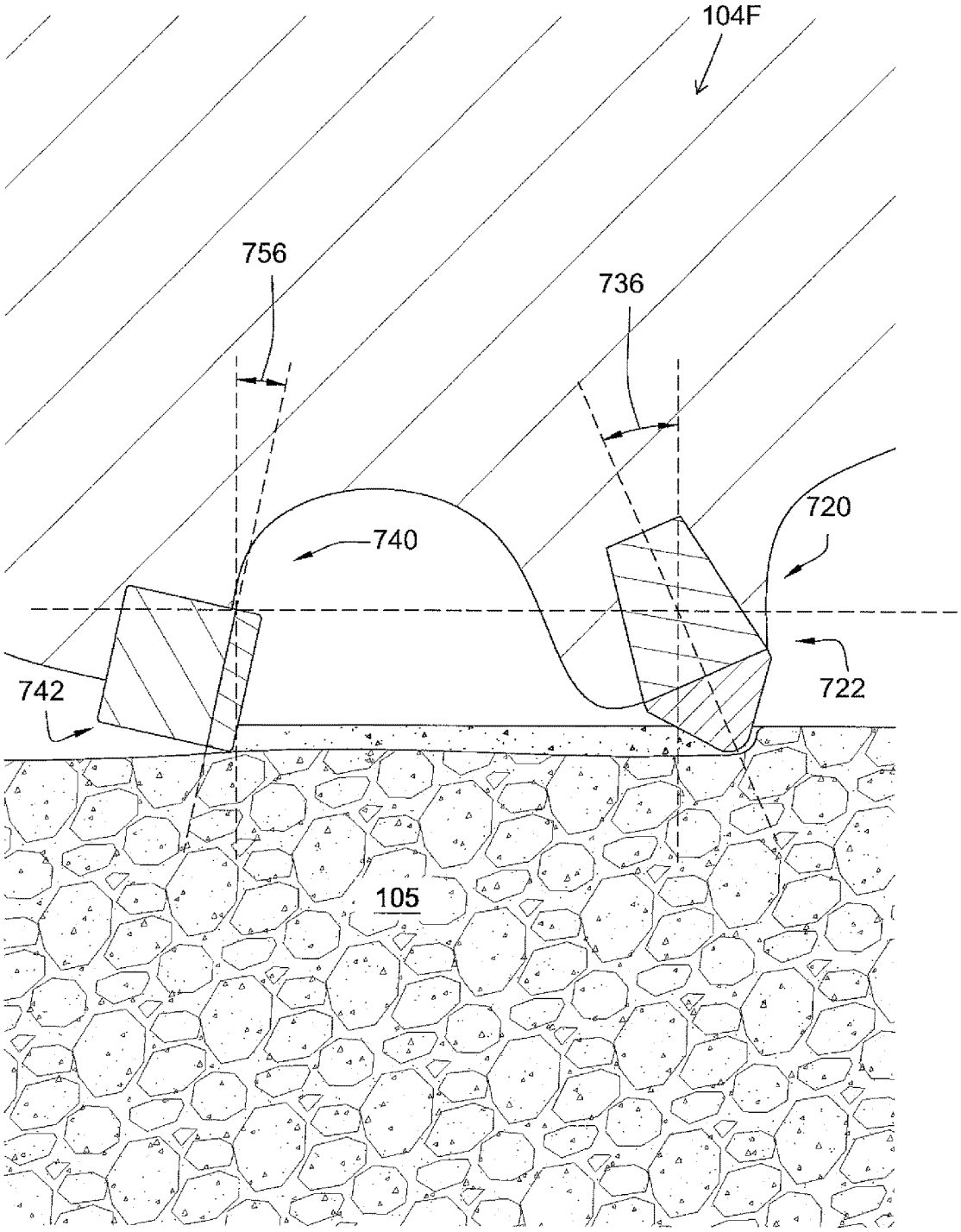
FIG. 7 is a cross-sectional diagram of an embodiment of a plurality of cutting elements positioned on a drill bit.

Referring now to FIG. 7, illustrated therein is another embodiment of the drill bit 104F having a shear cutting element 742 on a second blade 740 orientated at a negative rake angle 756, whereas a pointed cutting element 722 on a first blade 720 is orientated at a positive rake angle 736. It may be beneficial that cutting elements 722, 742 on adjacent blades 720, 740, respectively, have opposite rake angles such that the formation 105 may be more easily cut and removed. In this embodiment, the pointed cutting element 722 may plow through the formation 105 causing the cut formation to build up around the pointed cutting element. The shear cutting element 742, being radially offset from the pointed cutting element 722, may then easily remove the built up formation.

Figure 8:
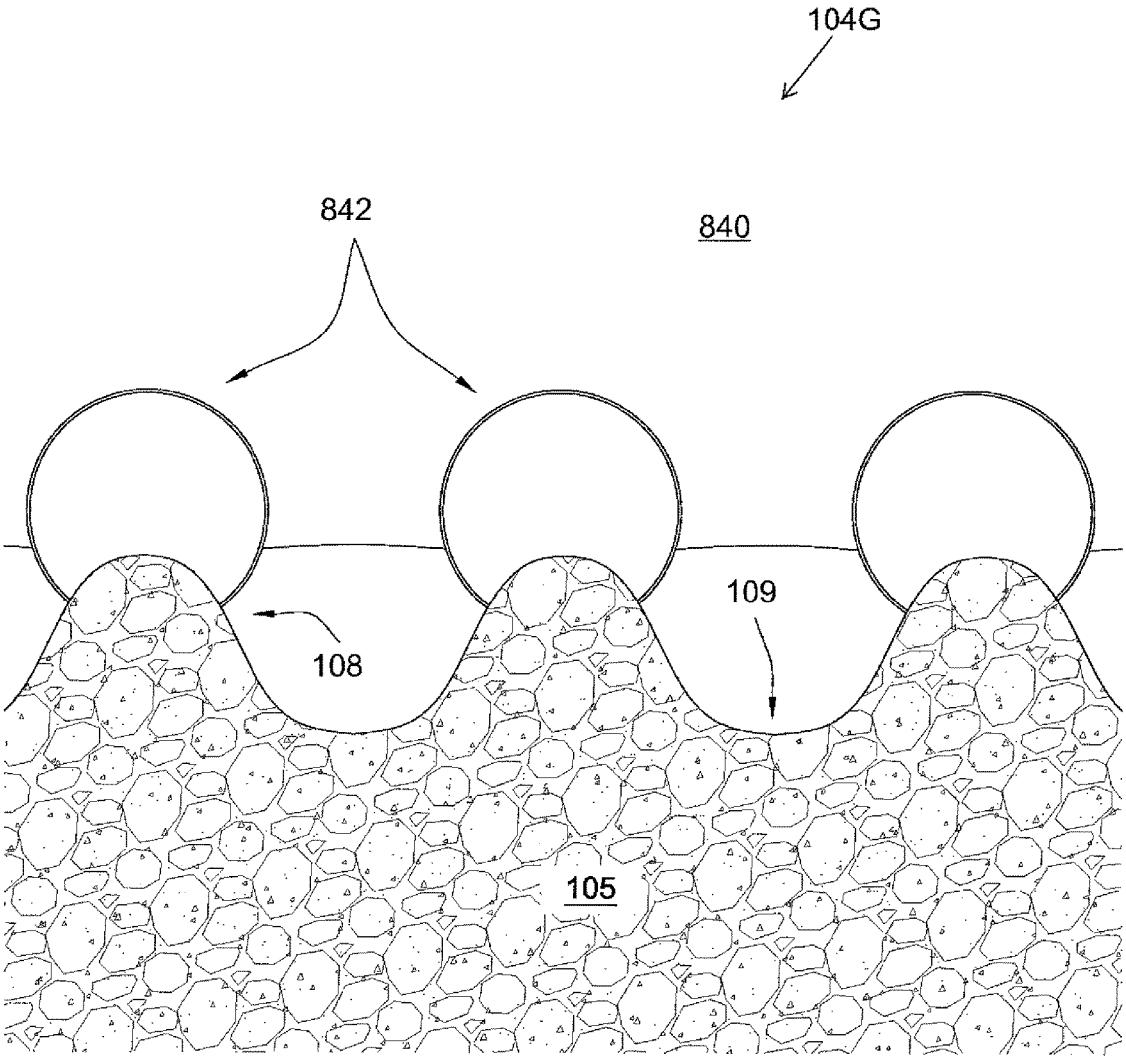
FIG. 8 is a cross-sectional diagram of another embodiment of a plurality of cutting elements positioned on a drill bit.

In the embodiment of the drill bit 104G illustrated in FIG. 8, a plurality of shear cutting elements 842 may be positioned on a second blade 840 such that as the drill bit rotates and its blades follow an intended cutting path, the shear cutting elements 842 may remove mounds of the formation 105 formed by a plurality of pointed cutting elements on an adjacent blade; the pointed cutting elements having plowed through a relatively soft formation 105 forming mounds 108 and valleys 109 during a drilling operation. This may be beneficial so that the formation may be evenly cut and removed downhole. It is believe that in harder formations, the pointed cutting elements will fracture the rock verses displacing it into mounds.

Figure 9:
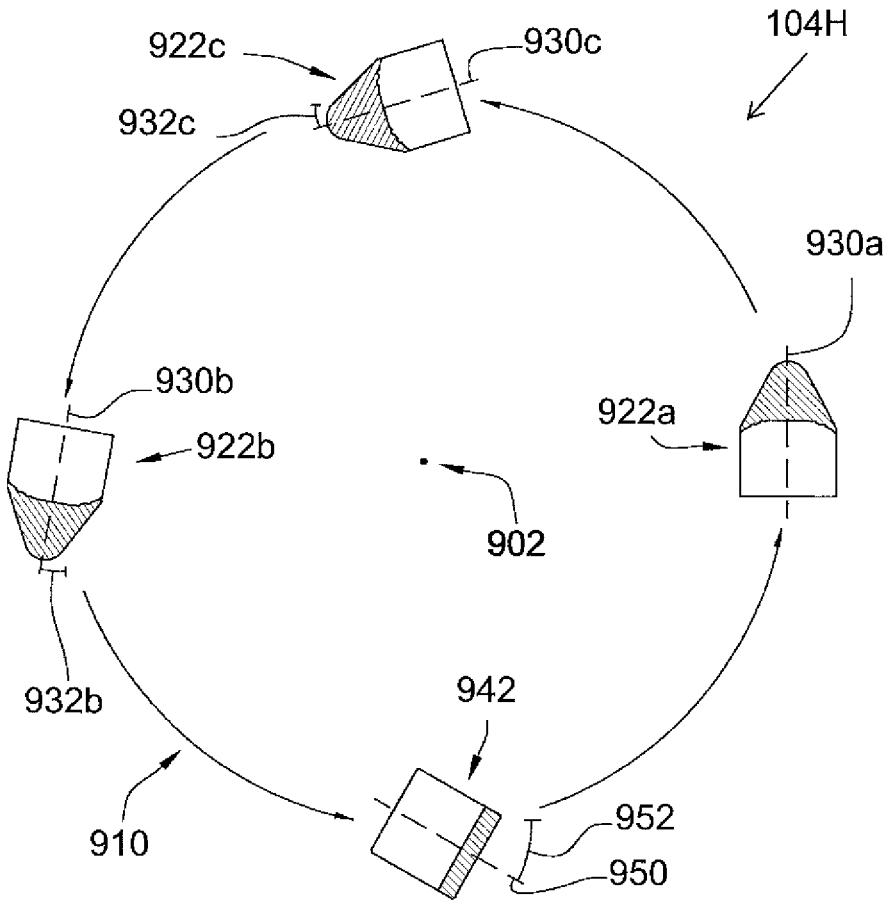
FIG. 9 is a representation of an embodiment pattern of a cutting element.

Referencing yet another representative embodiment of the drill bill 104H, FIG. 9 illustrates a central axis 930*a* of a pointed cutting element 922*a* tangent to an intended cutting path 910 formed by the working face of the drill bit during a downhole drilling operation. The central axis 930*b* of another pointed cutting element 922*b* may be angled away from a center 902 of the cutting path 910. The central axis 930*b* of the angled pointed cutting element 922*b* may form a smaller angle 932*b* with the cutting path 910 than an angle 952 formed by the central axis 920 and the cutting path 910 of an angled shear cutting element 942. In other embodiments, the central axis 930*c* of another pointed cutting element 922*c* may form an angle 932*c* with the cutting path 910 such that the cutting element 922*c* angles towards the center 902 of the cutting path 910.

Figure 10:
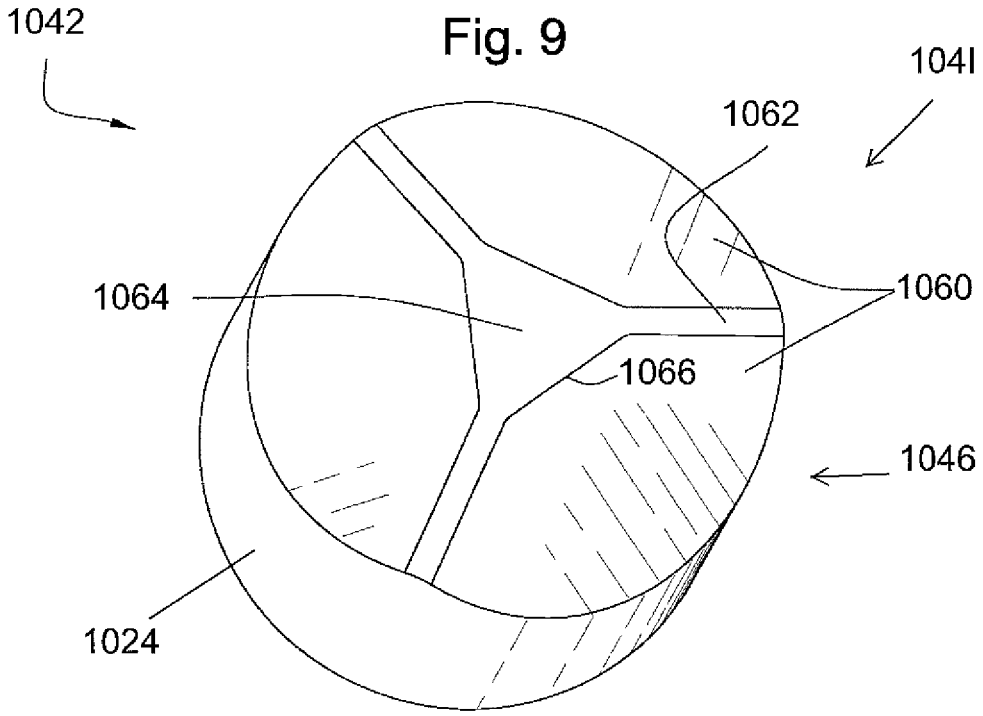
FIG. 10 is a perspective diagram of an embodiment of a carbide substrate.

In the embodiment 1041 of FIG. 10, the non-planar interface of a shear cutting element 1042 may have a diamond working end 1046 including at least two circumferentially adjacent diamond working surfaces 1060, each angled outwardly and downwardly from a central axis of the second carbide substrate 1044. In this embodiment, the carbide substrate 1044 may comprise a junction 1062 between adjacent working surfaces 1060; the junction 1062 having a radius of 0.060 to 0.140 inch. Another junction 1066 between a flatted portion 1064 and each working surface 1060 may comprise a radius of 0.055 to 0.085 inch. When the shear cutting element 1042 is worn, it may be removed from the blade of the drill bit (not shown), rotated, re-attached such that another working surface 1060 is presented to the formation. This may allow for the bit to continue degrading the formation and effectively increase its working life. In this embodiment, the working surfaces 1060 may have equal areas. However, in other embodiments the working surfaces may comprise different areas.

Figure 11:
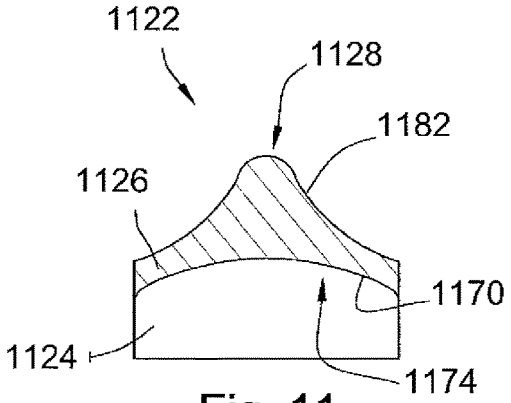
FIG. 11 is a cross-sectional diagram of an embodiment of a pointed cutting element.

FIGS. 11 through 18 show various embodiments of a pointed cutting element with a diamond working end bonded to a carbide substrate, and with the diamond working end having a tapered outer surface and a pointed geometry. For example, FIG. 11 illustrates a pointed cutting element 1122 with a pointed geometry 1128 having a concave outer surface 1182 and a continuous convex geometry 1174 at an interface 1170 between the substrate 1124 and the diamond working end 1126.

Figure 12:
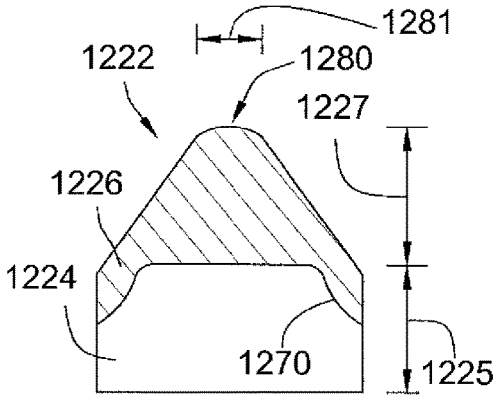
FIG. 12 is a cross-sectional diagram of another embodiment of a pointed cutting element.

FIG. 12 comprises an embodiment of a thicker diamond working end from the apex 1280 to the non-planar interface 1270, while still maintaining a radius 1281 of 0.050 to 0.200 inch. The diamond working end 1226 may comprise a thickness 1227 of 0.050 to 0.500 inch. The carbide substrate 1224 may comprise a thickness 1225 of 0.200 to 1 inch from a base of the carbide substrate to the non-planar interface 1270.

Figure 13:
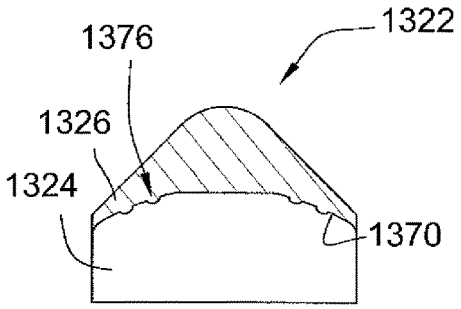
FIG. 13 is a cross-sectional diagram of another embodiment of a pointed cutting element.

FIG. 13 illustrates grooves 1376 formed in the substrate 1324. It is believed that the grooves 1376 may help to increase the strength of the pointed cutting element 1322 at the interface 1370 between the carbide substrate 1324 and the diamond working end 1326.

Figure 14:
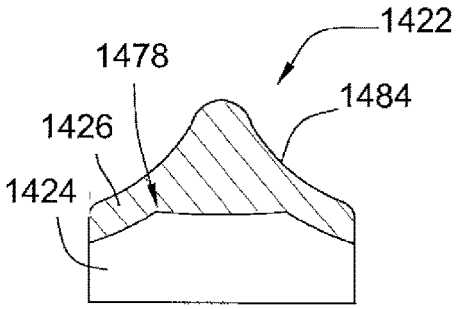
FIG. 14 is a cross-sectional diagram of another embodiment of a pointed cutting element.

FIG. 14 illustrates a pointed cutting element 1422 having a slightly concave geometry 1478 at the interface 1470 between the carbide substrate 1424 and the diamond working end 1426, and with the diamond working end 1426 a concave outer surface 1484.

Figure 15:
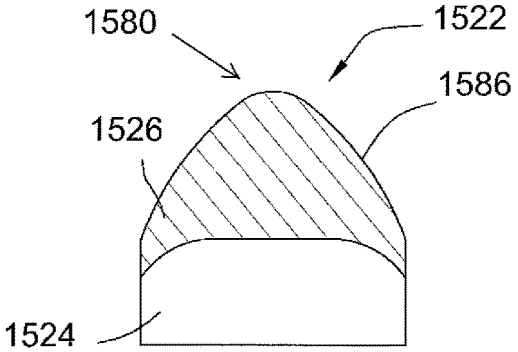
FIG. 15 is a cross-sectional diagram of another embodiment of a pointed cutting element.

FIG. 15 discloses a pointed cutting element 1522 having a diamond working end 1526 with a slightly convex outer surface 1586 of the pointed geometry while still maintaining a 0.050 to 0.200 inch radius at the apex 1580.

Figure 16:
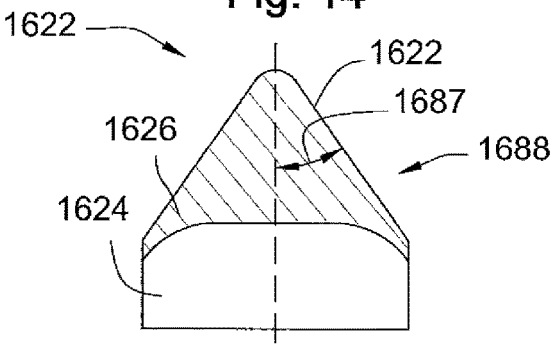
FIG. 16 is a cross-sectional diagram of another embodiment of a pointed cutting element.

FIG. 16 discloses a pointed cutting element 1622 having a diamond working end 1526 having a flat sided pointed geometry 1528. In some embodiments, an outer surface 1688 and a central axis of the diamond working end 1626 may generally form a 35 to 45 degree included angle 1687.

Figure 17:
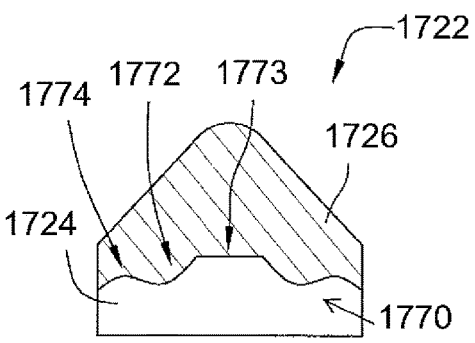
FIG. 17 is a cross-sectional diagram of another embodiment of a pointed cutting element.

FIG. 17 discloses a pointed cutting element 1722 having a interface 1770 between the carbide substrate 1724 and the diamond working end 1726 that includes a concave portion 1774 and a convex portion 1772 and a generally flatted central portion 1773.

Figure 18:
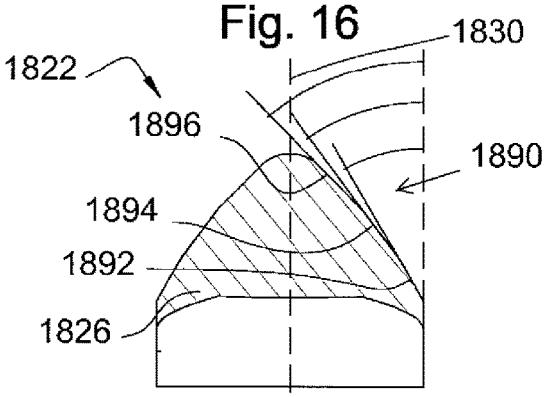
FIG. 18 is a cross-sectional diagram of another embodiment of a pointed cutting element.

In the embodiment of a pointed cutting element 1822 illustrated in FIG. 18, the diamond working end 1826 may have a convex outer surface 1890 comprising different general angles at a lower portion 1892, a middle portion 1894, and an upper portion 1896 with respect to the central axis 1830 of the cutting element. The lower portion 1892 of the side surface 1890 may be angled at substantially 25 to 33 degrees from the central axis 1830, the middle portion 1894, which may make up a majority of the convex surface, may be angled at substantially 22 to 40 degrees from the central axis 1830, and the upper portion 1896 of the side surface may be angled at substantially 40 to 50 degrees from the central axis 1830.

Whereas the present invention has been described in particular relation to the drawings attached hereto, it should be understood that other and further modifications apart from those shown or suggested herein, may be made within the scope and spirit of the present invention.

What is claimed is:

1. A downhole cutting tool, comprising:

a tool body;

a plurality of blades extending from the tool body; and a plurality of cutting elements coupled to the plurality of blades and which collectively define a cutting profile when the plurality of blades are superimposed on each other, the plurality of cutting elements including:

a first cutting element having a working end of a first geometry, the first cutting element being oriented at a non-zero side rake; and a second cutting element having a working end of a second geometry that is different than the first geometry, the first cutting element rotationally trailing the second cutting element and the first and second cutting elements overlapping in the cutting profile, and a central axis of the second cutting element being radially or angularly offset from a central axis of the first cutting element when the plurality of blades are superimposed on each other.

2. The downhole cutting tool of claim 1, the first cutting element being a pointed cutting element, the working end of the pointed cutting element forming an apex.

3. The downhole cutting tool of claim 2, a thickness of the working end being measured axially from an outer surface of the pointed cutting element to an interface with a substrate, and the thickness being greatest at the apex.

4. The downhole cutting tool of claim 2, the pointed cutting element including a concave side wall between the apex and an interface with a substrate.

5. The downhole cutting tool of claim 2, the pointed cutting element including a convex side wall between the apex and an interface with a substrate.

6. The downhole cutting tool of claim 2, the pointed cutting element including a side wall that in cross-section is flat and which forms an included angle between 35° and 45° relative to the central axis of the pointed cutting element.

7. The downhole cutting tool of claim 2, the apex having a radius of curvature between 0.050 inch and 0.200 inch.

8. The downhole cutting tool of claim 1, the second cutting element being a shear cutting element, the working end of the shear cutting element forming a planar cutting surface.

9. The downhole cutting tool of claim 1, the first cutting element being on a first blade of the plurality of blades, and the second cutting element being on a second blade of the plurality of blades.

10. The downhole cutting tool of claim 9, the first blade being adjacent to, and rotationally leading, the second blade.

11. The downhole cutting tool of claim 9, the second blade being adjacent to, and rotationally leading, the first blade.

12. The downhole cutting tool of claim 9, the plurality of blades including a plurality of first blades alternating with a plurality of second blades.

13. The downhole cutting tool of claim 1, the first cutting element and the second cutting element having different rake angles.

14. The downhole cutting tool of claim 1, the plurality of cutting elements including a third cutting element having a working end of the first geometry, the central axis of the first cutting element being at a different angle relative to an intended cutting path formed by a working face of the downhole cutting tool than a central axis of the third cutting element.

15. A fixed cutter drill bit, comprising:

a tool body;

a plurality of blades extending from the tool body; and a plurality of cutting elements coupled to the plurality of blades, the plurality of cutting elements including:

a plurality of pointed cutting elements including a working end with a substantially pointed geometry that is opposite a first base; and a plurality of shear cutters on a second blade of the plurality of blades, the plurality of shear cutting elements including a working end with a planar cutting surface opposite a second base, and an innermost shear cutting element of the plurality of shear cutting elements being nearer a center of a working face of the tool body than an innermost pointed cutting element of the plurality of pointed cutting elements.

16. The fixed cutter drill bit of claim 15, a central axis of at least one of the plurality of pointed cutting elements being angled relative to a central axis of at least one of the plurality of shear cutting elements.

17. The fixed cutter drill bit of claim 15, the substantially pointed geometry including a side wall that tangentially joins an apex having a radius of curvature.

18. The fixed cutter drill bit of claim 15, wherein when the plurality of blades are superimposed on each other, a central axis of at least one of the plurality of pointed cutting elements is radially between central axes of at least two of the plurality of shear cutting elements, and a central axis of at least one of the plurality of shear cutting elements is radially between central axes of at least two of the plurality of pointed cutting elements.

19. The fixed cutter drill bit of claim 15, the pointed cutting element including a flat side wall forming an included angle between 35° and 45° relative to the central axis of the pointed cutting element.

20. A downhole cutting tool, comprising:

a tool body;

a plurality of blades extending from the tool body, each of the plurality of blades extending radially inwardly from a gauge of the tool body toward a central axis of the tool body; and a plurality of cutting elements coupled to the plurality of blades and which collectively define a cutting profile when the plurality of blades are superimposed on each other, the plurality of cutting elements including:

at least one first cutting element in a nose or flank of the cutting profile and having a working end of a first geometry having a pointed end and a side wall that is flat in a cross-sectional view, the at least one first cutting element being oriented at a non-zero back rake angle and at a non-zero side rake angle; and at least one second cutting element having a working end of a second geometry that is different than the first geometry, and which leads the at least one first cutting element and which overlaps the at least one first cutting element in the cutting profile.

21. The downhole cutting tool of claim 20, the first geometry being a pointed geometry with an apex, and the second geometry being a shear geometry with a planar cutting face.

22. The downhole cutting tool of claim 20, the side wall forming an included angle between 35° and 45° relative to a central axis of the first cutting element.

* * * * *